US011545053B2

(12) United States Patent
Wieneke et al.

(10) Patent No.: US 11,545,053 B2
(45) Date of Patent: Jan. 3, 2023

(54) PRINTER FOR PRINTING A CABLE MARKER STRIP, AND CABLE MARKER STRIP FOR THE SAME

(71) Applicant: Weidmüller Interface GmbH & Co. KG, Detmold (DE)

(72) Inventors: Andreas Wieneke, Lemgo (DE); Markus Dahlmann, Rheda-Wiedenbrück (DE); Faysal Dogan, Horn-Bad Meinberg (DE)

(73) Assignee: WEIDMÜLLER INTERFACE GMBH & CO. KG

( * ) Notice: Subject to any disclaimer, the term of this patent is extended or adjusted under 35 U.S.C. 154(b) by 64 days.

(21) Appl. No.: 17/053,462

(22) PCT Filed: Jun. 5, 2019

(86) PCT No.: PCT/EP2019/064630
§ 371 (c)(1),
(2) Date: Nov. 6, 2020

(87) PCT Pub. No.: WO2019/238492
PCT Pub. Date: Dec. 19, 2019

(65) Prior Publication Data

US 2021/0233435 A1 Jul. 29, 2021

(30) Foreign Application Priority Data

Jun. 15, 2018 (DE) ..... 102018114397.4

(51) Int. Cl.
*G09F 3/20* (2006.01)
*B41J 3/407* (2006.01)
(Continued)

(52) U.S. Cl.
CPC ..... *G09F 3/205* (2013.01); *B41F 17/00* (2013.01); *B41J 3/4075* (2013.01); *G09F 3/06* (2013.01);
(Continued)

(58) Field of Classification Search
CPC combination set(s) only.
See application file for complete search history.

(56) References Cited

U.S. PATENT DOCUMENTS 3,193,614 A 7/1965 Richards
3,570,450 A 3/1971 Geating
(Continued)

FOREIGN PATENT DOCUMENTS

DE 6927061 U 12/1969
DE 2654996 A1 6/1978
(Continued)

*Primary Examiner* — Jennifer Bahls

(74) *Attorney, Agent, or Firm* — Laubscher & Laubscher PC

(57) ABSTRACT

A cable marker strip includes two rows of cable markers which are arranged behind one another in a cable direction. The cable marker strip includes a labeling track which has one labeling surface for each cable marker, wherein one fastening structure is provided for each cable marker on a fastening surface of the labeling track. The fastening surface lies opposite the labeling surface and has a connecting track
(Continued)

and two holding limbs which are connected to the connecting track, which lie opposite one another, and together define a cable receptacle. Starting from the connecting track, spacing the holding limbs from one another decreases in the region of the cable receptacle so that the cable receptacle tapers. A printer for printing the cable marker strip and a method for printing the cable marker strip by way of the printer are also provided. The printer includes a print head which is arranged above pressure bars for the rows of cable markers.

7 Claims, 10 Drawing Sheets

(51) Int. Cl.
*G09F 3/06* (2006.01)
*B41F 17/00* (2006.01)
*G09F 3/02* (2006.01)

(52) U.S. Cl.
CPC .. *B41P 2217/50* (2013.01); *G09F 2003/0201* (2013.01)

(56) References Cited

U.S. PATENT DOCUMENTS

| | | | | |
|---|---|---|---|---|
| 3,894,731 | A * | 7/1975 | Evans | G09F 3/0295 101/35 |
| 4,899,474 | A | 2/1990 | Piana et al. | |
| 10,369,735 | B2 | 8/2019 | Speith et al. | |
| 2015/0040447 | A1 * | 2/2015 | Ganster | G09F 3/02 40/647 |
| 2019/0061370 | A1 * | 2/2019 | Haase | B41J 3/407 |
| 2020/0023652 | A1 | 1/2020 | Speith et al. | |

FOREIGN PATENT DOCUMENTS

| | | | | |
|---|---|---|---|---|
| DE | 8423747 | U | 11/1984 | |
| DE | 9308696 | U1 | 8/1993 | |
| DE | 69208046 | T2 | 10/1996 | |
| DE | 102015109020 | A1 | 3/2016 | |
| DE | 202017102224 | U1 * | 8/2018 | B41J 11/057 |
| GB | 2237261 | A | 5/1991 | |
| GB | 2320225 | A * | 6/1998 | B41J 2/325 |

* cited by examiner

PRINTER FOR PRINTING A CABLE MARKER STRIP, AND CABLE MARKER STRIP FOR THE SAME

This application is a § 371 National Stage Entry of International Patent Application No. PCT/EP2019/064630 filed Jun. 5, 2019. Application No. PCT/EP2019/064630 claims priority of DE 10 2018 114 397.4 filed Jun. 15, 2018. The entire content of these applications is incorporated herein by reference.

BACKGROUND OF THE INVENTION

The present invention relates to a cable marker strip with at least one, and preferably two, rows of cable markers which are arranged behind one another in a cable direction. The cable marker strip includes a labeling track which has in each case one labeling surface for each cable marker, wherein in each case one fastening structure is provided for each cable marker on a fastening surface of the labeling track. The fastening surface lies opposite the labeling surface, and the fastening structure has a connecting track and two holding limbs which are connected to the connecting track, which lie opposite one another, and together define a cable receptacle. Furthermore, the present invention relates to a printer for printing the cable marker strip, and to a method for printing the cable marker strip by way of the printer.

BRIEF DESCRIPTION OF THE PRIOR ART

In order to keep track of a large number of cables and electrical conductors to be connected and laid out together during electrical installations, it is common to not only use different colored cables, but to also label or mark the cables and conductors. Unless other means are available, adhesive tape is often used for this purpose as a makeshift solution, which must be dispensed from an endless roller, cut off and placed around the cable with some effort, such that excess tape strips remain on both sides. These excess strips are then adhesively stuck together to form a flag, which can be labeled. The labeling is often done with a ballpoint pen, a pencil or a felt pen, and is therefore often difficult to read the labelling on the adhesive tape which usually fades very quickly. In addition, the adhesive tape can dissolve and be lost, especially under the influence of heat.

This solution is unsuitable in a professional environment, for example in the assembly of control cabinets or in the context of production plants, because the labeling is very time-consuming, the marking is not sufficient and/or not permanently legible, and can even be lost.

The publication DE 10 2015 109 020 A1 describes a marking strip with marking elements which are intended for marking and/or labeling a terminal block arrangement. The marker strip is made of multiple plastics of different hardness, for example using a multi-component co-extrusion method, is printable, and can be snapped onto the terminal block assembly.

The problem underlying the present invention is to create a printable cable marker strip with cable markers for marking and/or labeling electrical conductors and/or cables, which can be easily labeled and/or printed and to create a printer for printing the cable marker strip.

SUMMARY OF THE INVENTION

For this purpose, a cable marker strip is created with at least one row, and preferably with two rows, of cable markers arranged one after another in a cable direction. The cable marker strip includes a labeling track which has a labeling surface for each cable marker. A fastening structure is provided for each cable marker on a fastening surface of the labeling track opposite the labeling surface.

Compared to the fastening structure, the labeling track is made of a softer plastic. In this context, it is preferred that the fastening structure is made of a mixture of polycarbonate and acrylonitrile butadiene styrene (PC-ABS) and the labeling track is made of a thermoplastic polyurethane (TPU). Thus, the fastening structure is heat-resistant and is very rigid. The pliability of the labeling track allows for printing on its entire surface.

Preferably, the connecting track is integrally connected to the fastening surface of the fastening track. In a particularly preferred embodiment, the cable marker is manufactured in one piece.

The fastening structure has a connecting track and two holding limbs which are connected to the connecting track, lie opposite one another, and together define a cable receptacle. Preferably, the fastening structure is formed approximately U-shaped.

The cable marker strip is characterized by the fact that, starting from the connecting track, spacing of the holding limbs from one another decreases in the region of the cable receptacle with the result that the cable receptacle tapers. An electrical conductor can be inserted into the cable receptacle. As the cable receptacle tapers, it is designed for the smallest possible cable and can still be used for cables with larger cable diameters due to the greater spacing of the holding limbs available below the connecting track.

The labeling track preferably extends in a cable direction and an arranging direction extends transversely to the same. Further preferably, the cable marker is formed symmetrically relative to a center plane which extends centrally and in a pressure direction transverse to the labeling track.

In order to ensure, even under vibration stress, that the marker does not detach from the cable, it is preferred that the spacing of the holding limbs from one another decreases as their distance from the connecting track increases. As a result, the cable receptacle is almost closed on the side facing the connecting track.

However, it is preferred that the respective holding limbs have a bend at an end of the cable receptacle spaced apart from the connecting track, at which bend they are spaced apart from one another by at least a small gap. The electrical conductor can be pushed through the gap into the cable receptacle. Therein, the bend forms a sliding surface, such that the electrical conductor is not damaged during the insertion.

Further, the bend of the holding limbs connects to respective lower ends, wherein the lower ends of the holding limbs are bent away from one another. Therefore, despite the hard material used for the cable receptacle, the electrical conductor is not damaged by the lower ends when inserted into the cable receptacle. Therein, the holding limbs are bent apart and spring back when the cable is arranged in the cable receptacle. The spring effect of the holding limbs holds the marker in its position.

The holding limbs are preferably narrower in the extent of the cable direction. It is preferred that the cable markers are also formed symmetrically to a second center plane which halves the holding limbs in the cable direction. The holding limbs therefore taper toward the lower end. This makes it easier to push the cable marker onto the electrical conductor.

The cable marker strip preferably has at least two rows of cable markers arranged one after another in the cable direction. Arranging the cable markers in rows allows for multiple cable markers to be printed simultaneously in the same printing process. In addition, arranging the cable markers side by side allows for greater operational stability when printing.

Preferably, the labeling track is widened on both sides of each row of cable markers by respective support surfaces. A support surface having approximately twice the width is preferably provided between two rows of cable markers. The support surface is used to transport the cable marker strip during printing. This additional support surface between the markers can also be used as a project labeling surface.

Furthermore, it is preferred that the labeling surface of the cable marker is defined on both sides by a notch extending in the cable direction. The notch can be detected by a sensor and used to correct the position of the cable marker strip during printing. In addition, it allows for an easier breaking away of the cable markers from the cable marker strip.

It is further preferred if a perforation is provided between respective, consecutively arranged cable markers which also serves for an easier breaking away of the cable marker from the cable marker strip.

The problem furthermore is solved by a cable marker which is detached from such a cable marker strip, in particular broken away.

A printer for printing a cable marker strip which includes one or multiple rows of cable markers arranged side by side in an arranging direction is also provided. The printer has a transport roller on which drive wheels are arranged in a rotationally fixed manner for transporting the cable marker strip in a transport direction.

The printer is characterized by the fact that respective pressure bars are provided for each row of cable markers. Respective pressure bars are arranged between two of the drive wheels, and each pressure bar has a contact surface which serves as a counter surface when printing the cable marker strip.

When printing the cable marker strip, the contact surface is pressed against the cable marker strip, in particular against the connecting strip, and holds the cable marker strip in its position and ensures a necessary pressure of the substrate to the print head.

For this purpose, the contact surface on the one hand is designed for insertion into a cable receptacle of one of the cable markers of the cable marker strip. The holding limbs of the connecting structure prevent the cable marker and the cable marker strip from being displaced in and against the arranging direction. On the other hand, the contact surface is designed, when printing the cable marker strip, to push a labeling surface of the cable marker in a pressure direction against a print head of the printer with a force, in particular a spring force. As a result, a labeling surface of the cable marker strip can be printed on its entire surface.

The pressure bar is preferably supported such that it can pivot about a pivot axis and has a carrier which extends transversely to the contact surface, wherein the contact surface extends approximately concentrically around the transport roller and has a tapered area at its front end relative to the transport direction. As the carrier extends transversely to the contact surface, it can enter into the cable receptacle through the gap between the holding limbs. The contact surface has a tapered area in order to be able to be inserted into the cable receptacle.

For transporting the cable marker strip, the drive wheels preferably each have a transport surface for bearing against the support surface which is contoured. The contour of the transport surface is preferably a ribbed contour or a splined contour. This allows for the cable marker strip to be conveyed safely in the transport direction.

For printing the cable marker strip, the printer preferably has a print head arranged above the pressure bar. Therein, a printing strip or ribbon is preferably arranged between the print head and the pressure bar, which printing ribbon is intended for printing the cable marker strip. The printer can print directly onto the marking surface, e.g., using thermal transfer technology. The cable marker strip can be conveyed step by step, such that a cable marker is labeled at each step, or continuously, wherein the printing ribbon is rolled onto the cable marker.

A method for printing such a cable marker strip with such a printer is also provided. In accordance with the method, a pressure bar is inserted from its tapered area into the cable receptacle of a cable marker of the cable marker strip, the printing ribbon with the print head is pressed onto the labeling surface of the cable marker, and the respective cable marker(s) are printed. The cable marker strip is transported ahead, for example by means of transport rollers, as which the pressure wheels can function.

Depending on the number of cable markers of the cable marker strip arranged side by side in the arranging direction, this method can be used to very quickly and permanently print the labeling surface of one or multiple cable markers arranged side by side using the printer. The labeling surface of the cable marker strip is designed to be labeled.

BRIEF DESCRIPTION OF THE FIGURES

Other objects and advantages of the subject invention will become apparent from a study of the following description when viewed in the light of the accompanying drawing, in which.

DETAILED DESCRIPTION

Figure 1A:
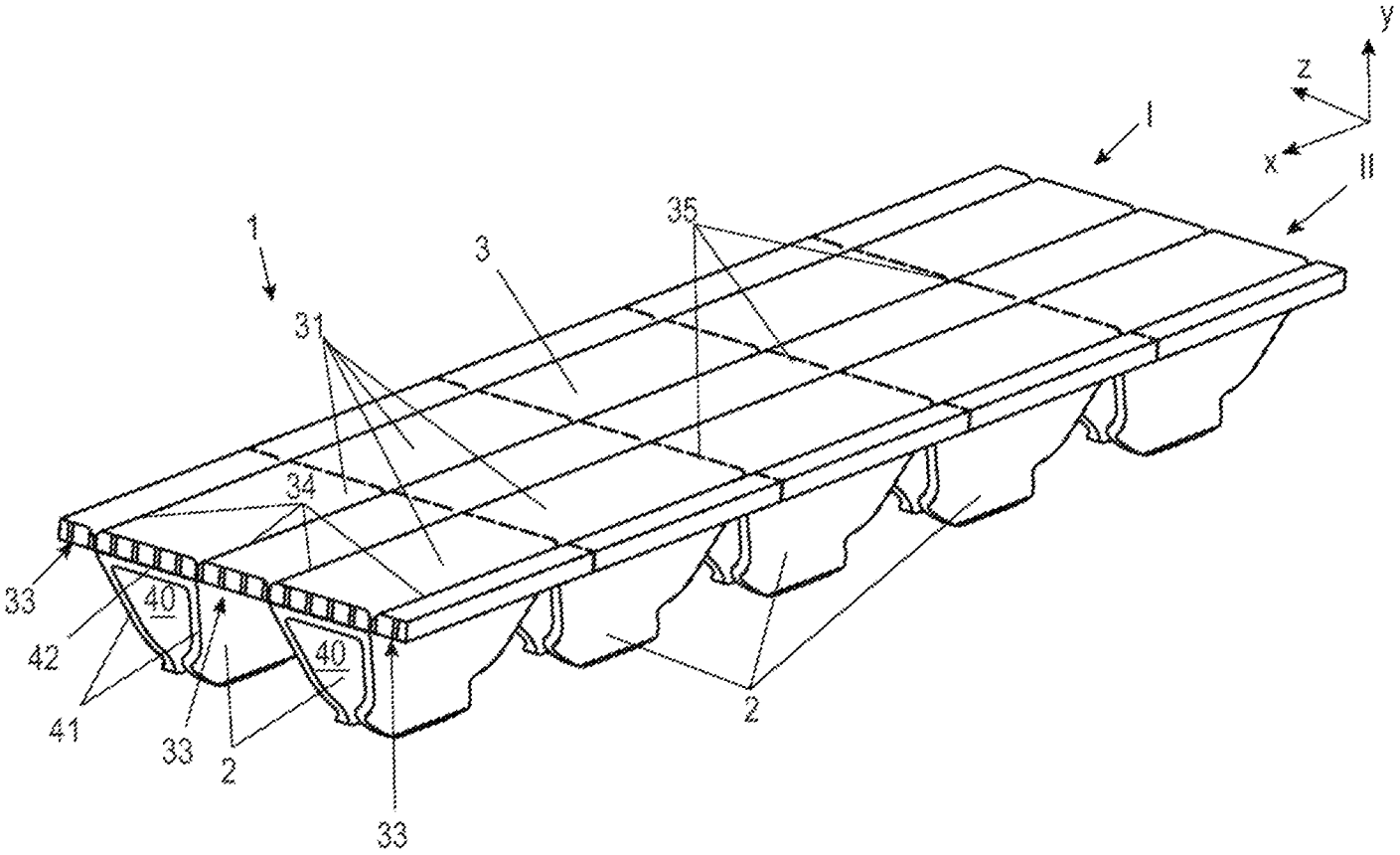
FIGS. 1*a, b*, and *c* are perspective, front and side views, respectively, of a cable marker strip with two rows of cable markers.
Figure 1B:
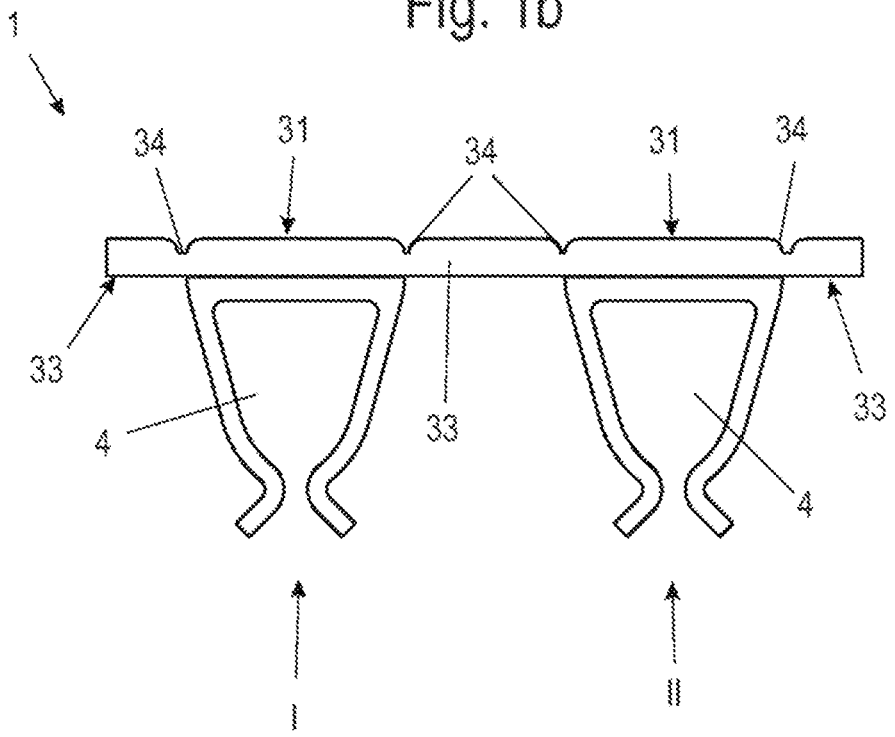
Figure 1C:
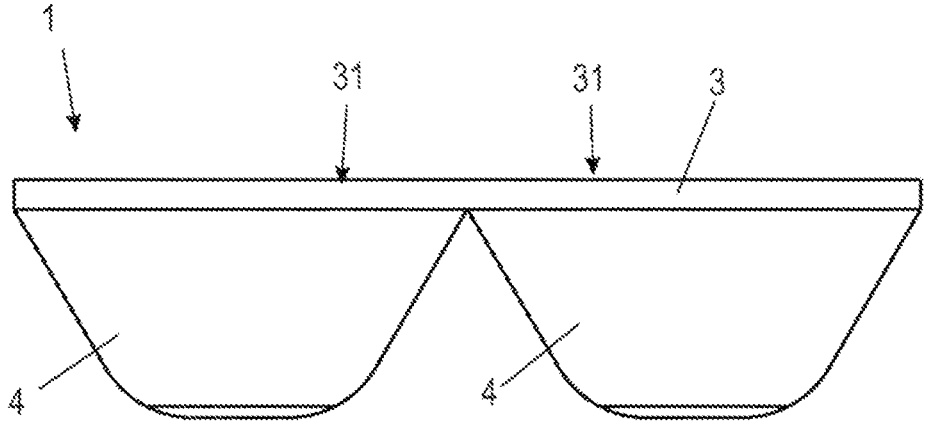

FIG. 1*a* shows a cable marker strip 1, which includes two rows I, II of cable markers 2 next to one another in arranged in the direction Z. FIG. 1*b* shows a front side of the cable marker strip 1 and FIG. 1*c* is a side view of such a cable marker strip 1 with two cable markers.

The cable marker strip 1 has a labeling track 3 which can be labeled and printed. The cable marker strip 1 extends in the cable direction X and has two rows I, II of cable markers 2 in the arranging direction Z transverse to the cable direction X. However, the invention also includes cable marker strips 1 with only one row of cable markers 2 and cable marker strips 1 with more than two rows I, II of cable markers 2.

Each cable marker 2 is associated with a labeling surface 31 on the labeling track 3, which labeling surface 31 is defined in the arranging direction z by notches 34. In addition, perforations 35 may be provided which are arranged one after another in the direction X, to separate the cable markers 2 from one another and completely penetrate the cable marker strip 1 in the arranging direction Z. The notches 34 and/or perforations 35 simplify the release of a cable marker 2 from the cable marker strip 1 after printing.

The labeling track 3 is widened on both sides of each row I, II of cable markers 2 by respective support surfaces 33. Between the two rows I, II, the support surface 33 is about twice as wide as outside of them. The support surface 33 is used for the transport of the cable marker strip 1 during printing and can also be used as a project labeling area or the like, if necessary.

Figure 2A:
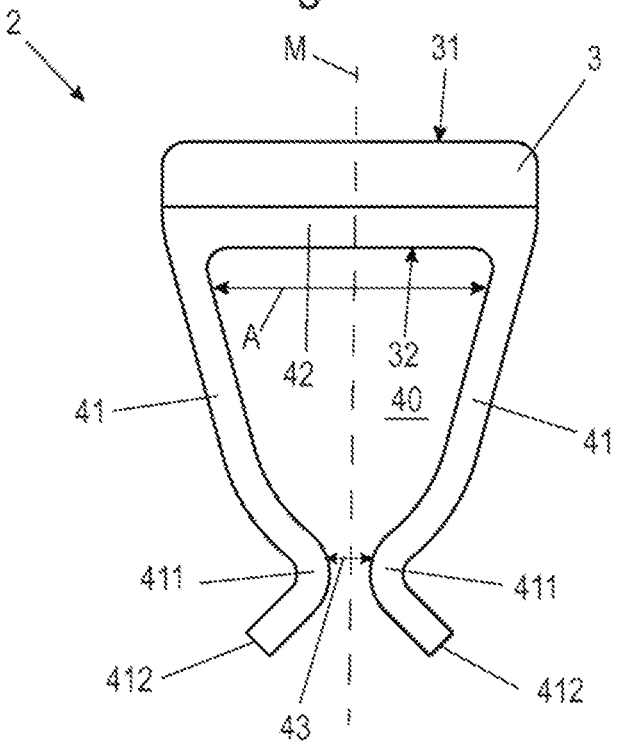
FIGS. 2*a, b*, and *c* are front, side and perspective views, respectively, of a cable marker according to the invention.
Figure 2B:
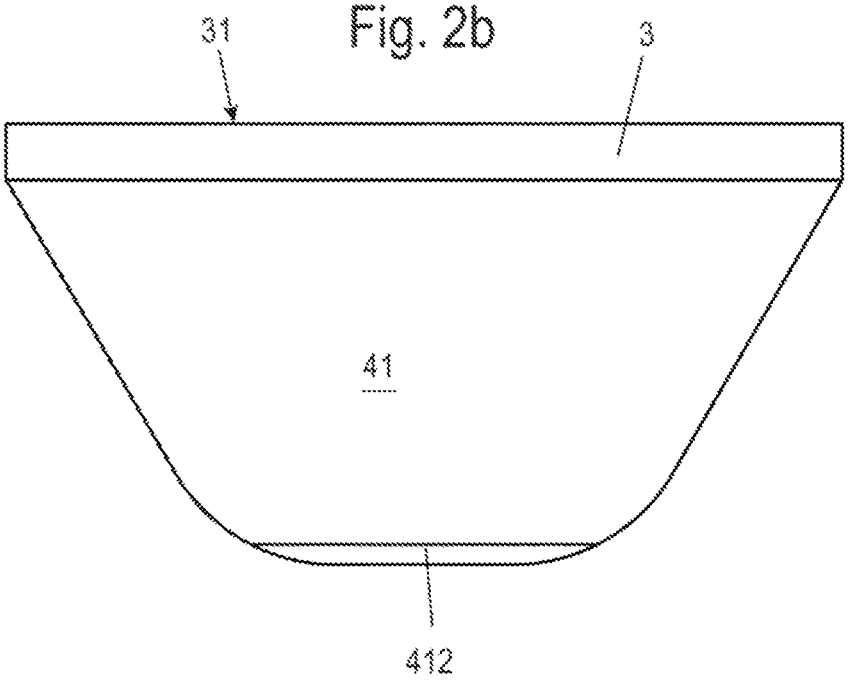
FIG. 2*d* is a perspective view of the cable marker of FIGS. 2*a-c* mounted on an electrical conductor.
Figure 2D:
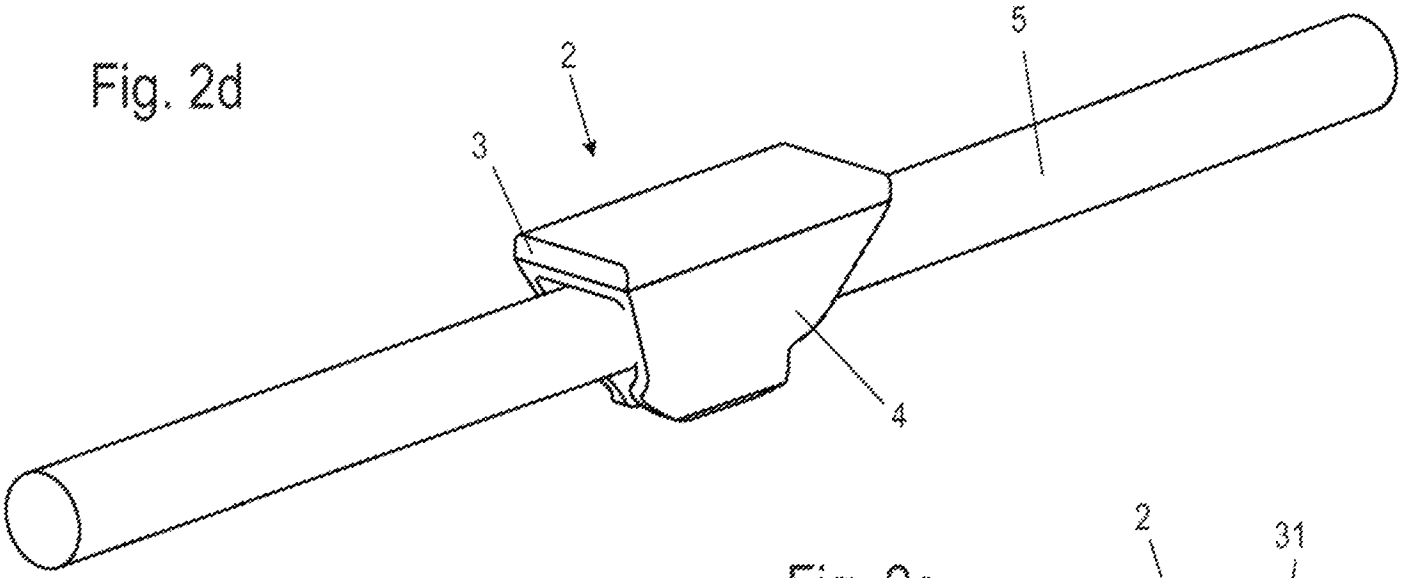
Figure 2C:
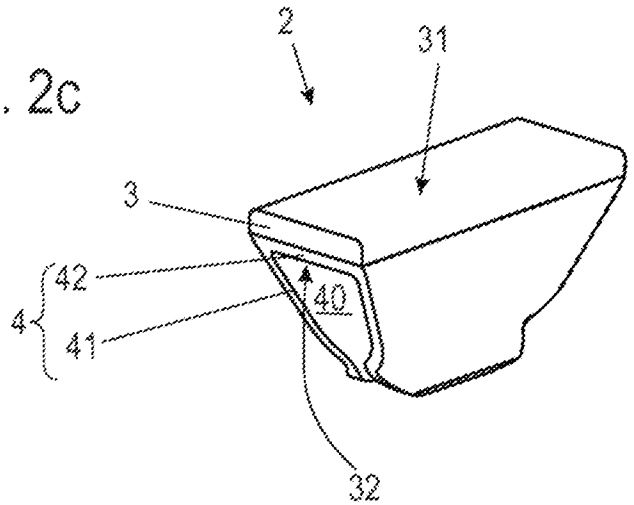

FIGS. 2*a-c* show a cable marker 2 detached from the cable marker strip 1 of FIG. 1*a*. FIG. 2*d* shows a cable marker 2 arranged on an electrical conductor 5. The cable marker 2 and the cable marker strip 1 are further described on the basis of these drawings.

The labeling track 3 of the cable marker strip 1 at its side facing away from the labeling surface 31 has a fastening surface 32 on which respective fastening structures 4 are arranged for each cable marker 2. The fastening structures 4 are made of one piece integral with the labeling track 3, in particular in a two-component co-extrusion method.

Each of the fastening structures 4 has a connecting track 42 with which two holding limbs 41 are connected on sides opposite to one another as seen in the arranging direction Z. Between the holding limbs 41 and the connecting track 42, a cable receptacle 40 is formed for accommodating the electrical conductor 5. The electrical conductor 5 can be inserted into the cable receptacle 40 in a pressure direction Y transverse to the cable direction X and transverse to the arranging direction Z. The cable marker 2 is formed symmetrically relative to a center plane M, which extends centrally between the holding limbs 41 and in a pressure direction Y, as well as transverse to the labeling track 3. The center plane M halves the labeling surface 31 in the arranging direction Z.

Each of the fastening structures 4 is therefore approximately U-shaped. However, a spacing A between the holding limbs 41 and the connecting track 42 decreases starting in the region of the cable receptacle 40, such that it tapers. Preferably, the cable receptacle 40 is designed for a smallest possible cable 5. Due to the greater spacing A of the holding limbs 41 near the connecting track 42, the cable marker 1 can also be used for cables with larger cross-sections. For this purpose, the holding limbs 41 are bent apart when pushing the cable marker 2 onto the electrical conductor 5, and then do not spring back completely.

Due to the tapered cable receptacle 40, the holding limbs 41, when the electrical conductor 5 is arranged in the cable receptacle 40, push against the conductor 5 with their spring force and hold the cable marker 2 in its position. The symmetrical design of the cable marker 2 causes a uniform pressure of both holding limbs 41.

The respective holding limbs 41 have a bend 411 at an end of the cable receptacle 40 spaced from the connecting track 42 at which bend 411 they are spaced from one another by a gap 43. The insertion of the electrical conductor 5 into the cable receptacle 40 is preferably performed through the gap 43, wherein the bend 411 of the holding limbs 41 serves as a sliding surface. In order for the cable marker 2 not to be damaged by the holding limbs 41, the bend 411 points outward. Thus, lower ends 412 of the holding limbs 41, which connect to the bend 411, are bent away from one another.

FIGS. 2*b-d* also show that the holding limbs 41 of the cable marker 2 are narrower in the cable direction X. Therein, the cable markers 2 are also formed symmetrically relative to a second center plane (not shown), which halves the holding limbs 41 in the cable direction X. The holding limbs 41 therefore taper toward the lower end 412. This makes it easier to push the cable marker 2 onto the electrical conductor 5. In addition, a considerable amount of production material can be saved this way.

Overall, the cable marker 2 can be easily and quickly pressed onto an electrical conductor 5 against the pressure direction Y, or the electrical conductor 5 can be inserted easily and quickly into the cable receptacle 40 in the pressure direction Y. The cable marker 2 is also securely held in the cable receptacle 40 due to its tapered shape and due to the spring effect of the holding limbs 41.

Figure 3A:
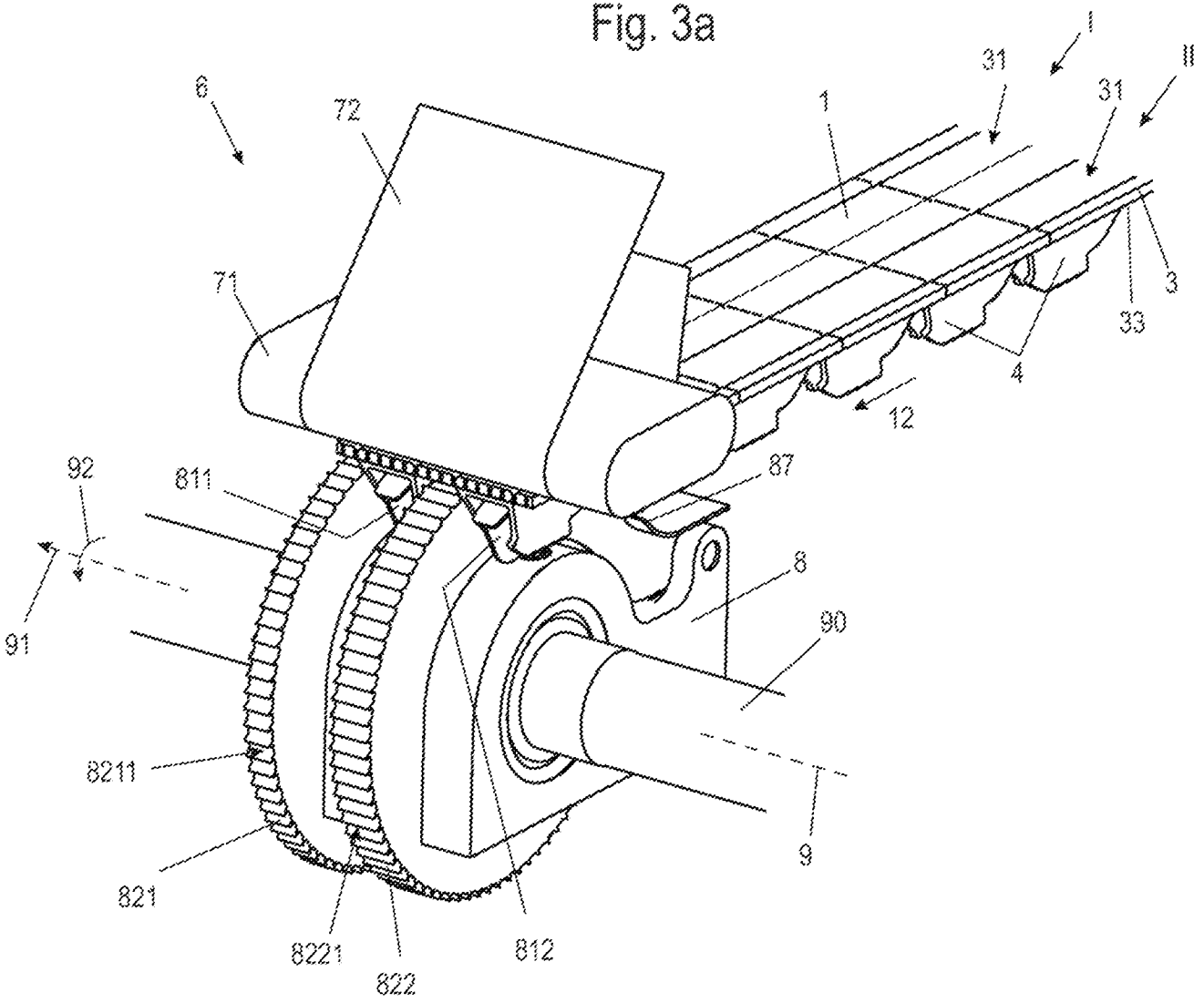
FIG. 3*a* is a perspective partial sectional view of a printer for printing the cable marker strip from FIG. 1 with the cable marker strip inserted in the printer.
Figure 3B:
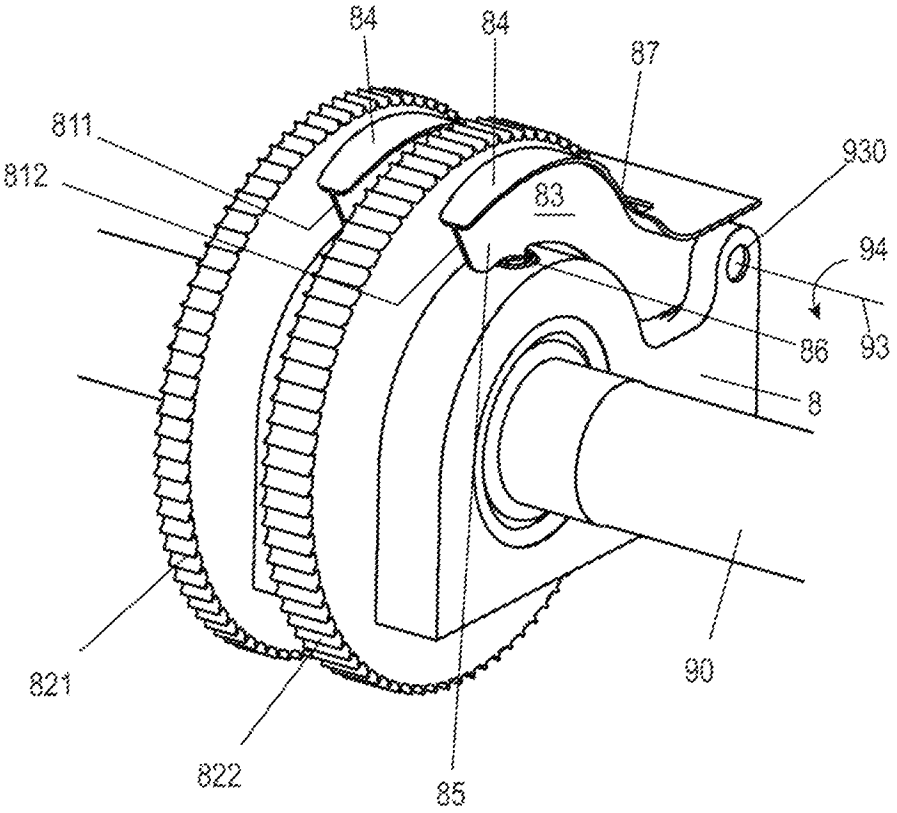
FIG. 3*b* is a sectional of the printer of FIG. 3*a* without the cable marker strip and without the print head.
Figure 3C:
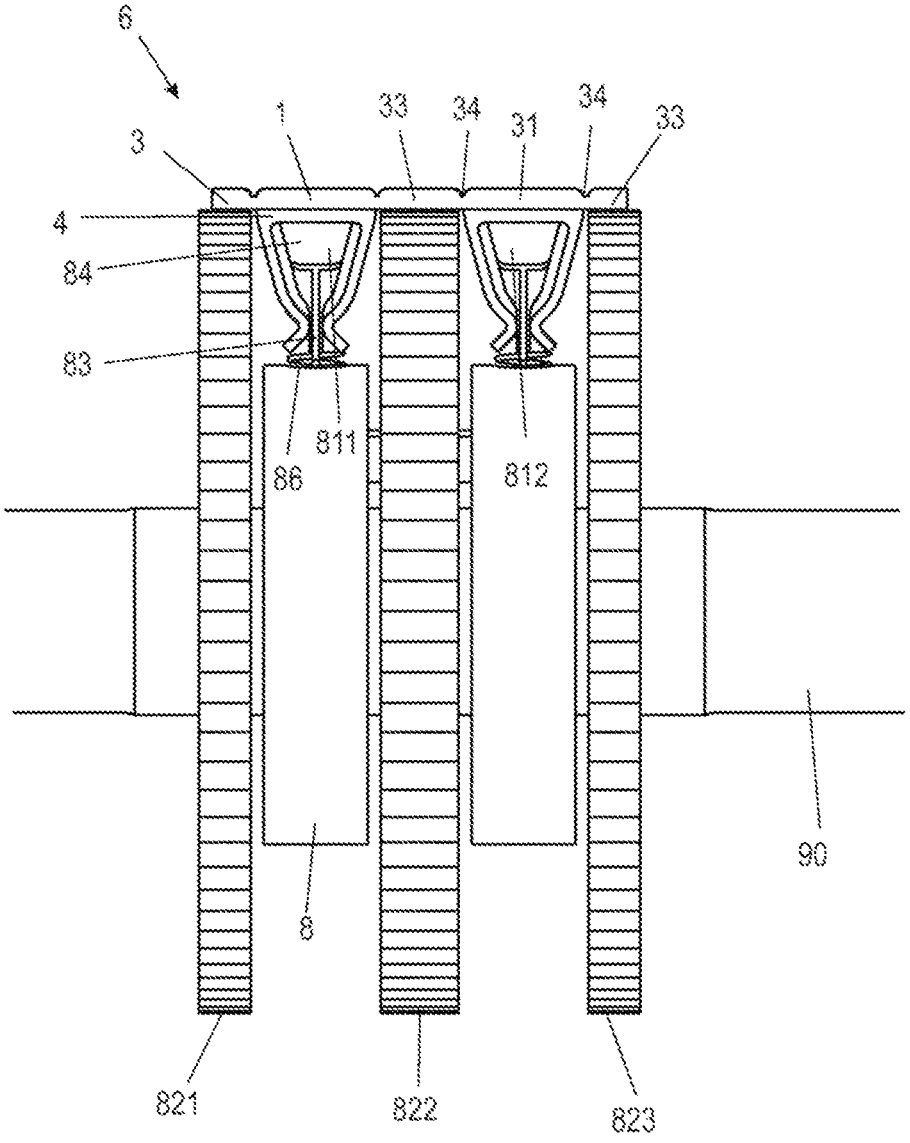
FIGS. 3*c* and 3*d* are end and side views, respectively, of the printer of FIG. 3*a* without a print head.
Figure 3D:
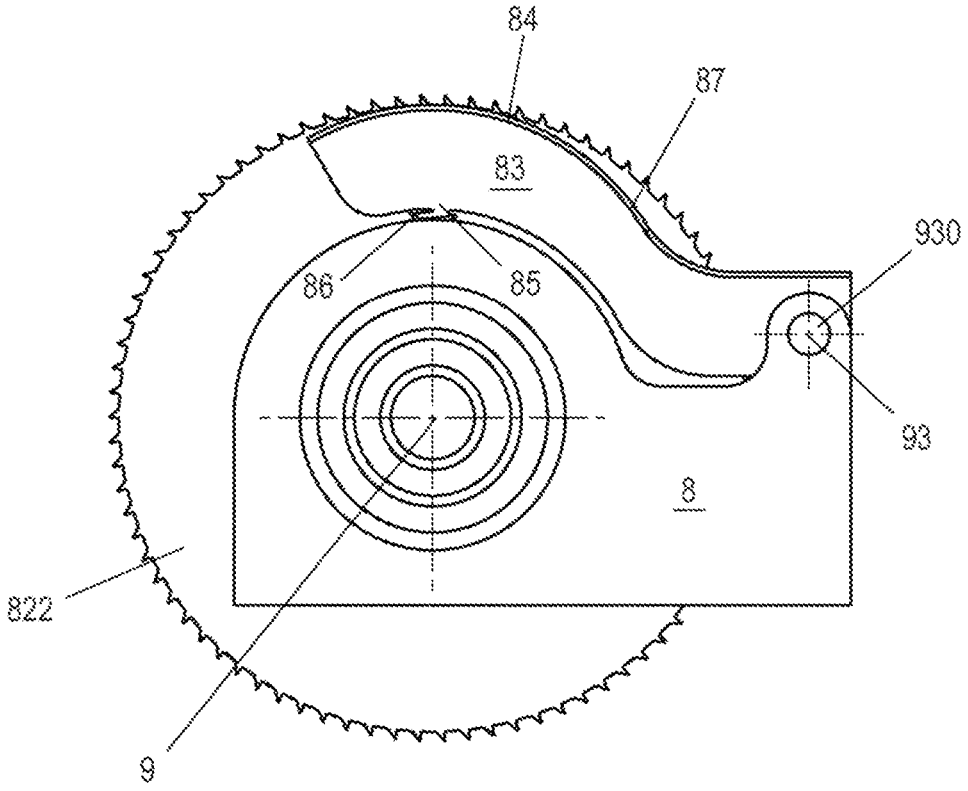

FIGS. 3*a*-3*d*_show a printer 6 for printing the cable marker strip 1. Therein, FIG. 3*a* shows a schematic, perspective view of the printer 6 with a cable marker strip 1 inserted in the printer 6; FIG. 3*b* shows the perspective view from FIG. 3*a* without the cable marker strip 1 and without a print head 71; FIG. 3*c* shows an end face of the printer 6 from FIG. 3*a* without a print head 71; and FIG. 3*d* shows a side view of-the printer of FIG. 3*b*.

The printer 6 is provided for printing the cable marker strip 1. For this purpose, it has a transport roller 90 on which drive wheels 821, 822, 823 are arranged in a rotationally fixed manner for transporting the cable marker strip 1 in a transport direction 12. The drive wheels 821, 822, 823 interact with the support surfaces 33 of the transport strip 3 which are provided on both sides of the rows I, II of the cable markers 2, respectively, on the transport strip 3.

For each row I, II of the cable marker 2, the printer 6 has respective pressure bars 811, 812, which are arranged between two of the drive wheels 821, 822, 823, respectively.

The pressure bars 811, 812 are each supported such that they can pivot about a pivot axis 93, which is formed by a pivot bolt supported in an opening 903 in a housing 8. The pressure bars 811, 812 have a smooth contact surface 84 as shown for example in FIGS. 3*b* and 3*c* which extends approximately concentrically around the transport roller 90 as well as a carrier 83 which extends transversely to the contact surface 84 and centered onto the same. The pressure bars 811, 812 are therefore designed approximately T-shaped in cross-section. In the embodiment shown, they are connected to each other by a cross member.

The contact surface 84 serves as a counter surface when printing the labeling surface 31 of a cable marker 2 of the cable marker strip 1. It is arranged in the cable receptacle 40 of the cable marker 2 when printing and is pressed against the connecting strip 42 of its fastening structure 4. This pushes the labeling surface 31 of the cable marker 2 against a print head 71 of the printer 6 in the pressure direction Y with the force of the spring. This contact/counter surface 84 could also be coated with Teflon or a similar material to obtain a better coefficient of friction.

The print head 71 is arranged above the pressure bar 811, 812 wherein a printing ribbon 72 for printing the cable marker strip 1 is arranged between the print head 71 and the pressure bar 811, 812. The printing ribbon 72 is therefore pressed against the labeling surface 31.

In order to insert the pressure bar 811, 812 into the cable receptacle 40, the contact surface 84 has a tapered area 87 at the front as seen in the transport direction 12. Thus, the pressure bar 811, 812 can be driven through the gap 43 between the holding limbs 41 into the cable receptacle 40. The carrier 83 is sufficiently narrow such that it penetrates the gap 43 at the contact surface 84 located in the cable receptacle 40. It extends along the center plane M, that is, in the direction X and in the pressure direction Y.

In order to print the entire area of the contact surface 84, the carrier 83 has a bar 85 which penetrates a spring 86 which pushes the pressure bar 811, 812 in the direction of the print head 71 with its spring force. The spring 86 is supported in the housing 8. The pressure bar 811, 812 is also rotatably supported about the pivot axis 93 such that it can pivot up and down.

In order to be able to securely transport the cable marker strip 1, the drive wheels 821, 822, 823 have respective transport surfaces 8211, 8221, which are provided for bearing against the support surface 33 of the labeling strip 3. The transport surfaces 8211, 8221 are contoured and have a ribbed, jagged or splined structure. This allows the cable marker strip to be transported effectively and evenly.

Figure 4A:
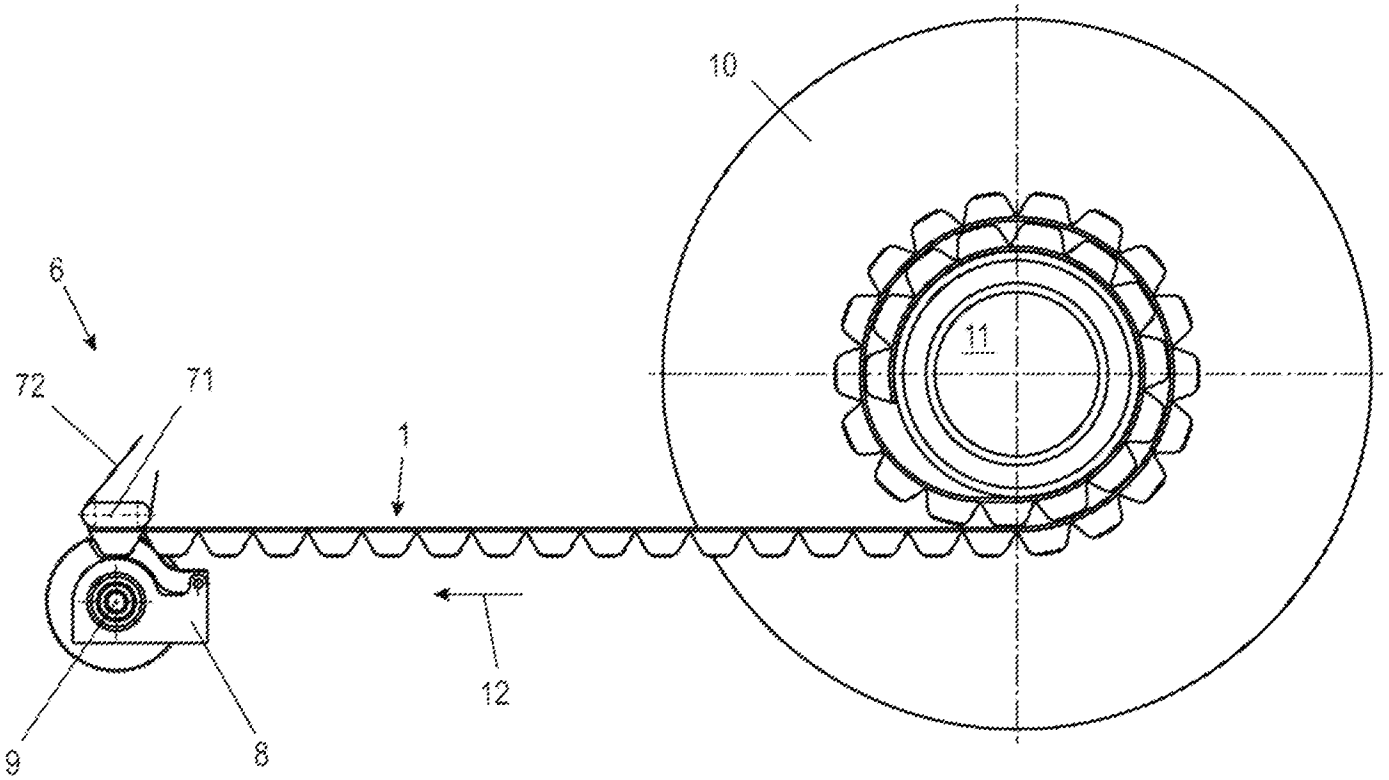
FIGS. 4*a* and 4*b* are side and perspective views, respectively, of the printer from FIG. 3 with a collecting roller for the cable marker strip.
Figure 4B:
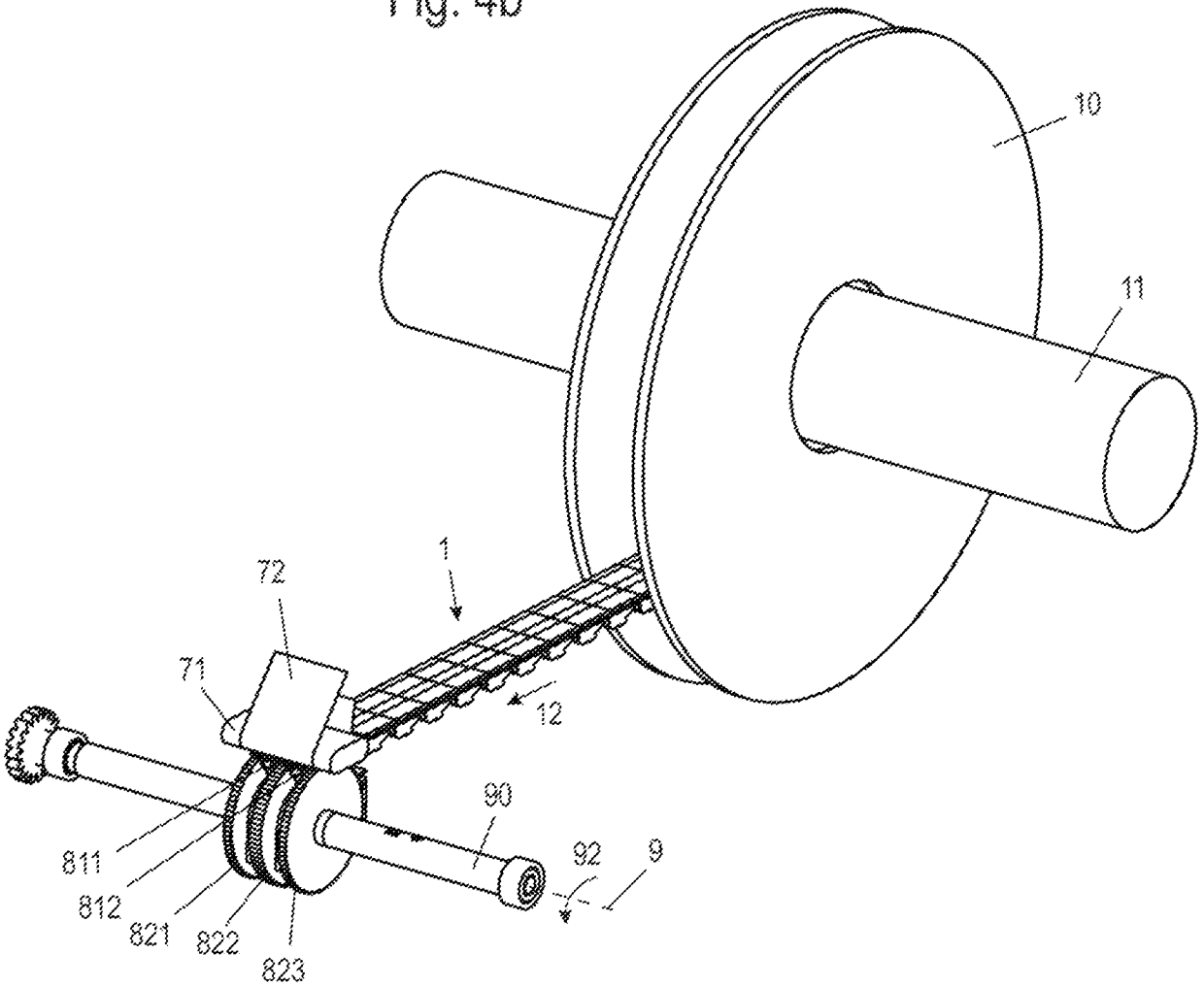

The printing of the cable marker strip 1 is shown in FIGS. 4*a* and 4*b*. FIG. 4*a* shows a side view and FIG. 4*bb* is a perspective view of the printer 6 from FIG. 3 with a collecting roller 10 for the cable marker strip 1. The collecting roller can be rotated about a rotary shaft 11.

For printing, the cable marker strip 1 is transported in the transport direction 12 by the drive wheels 821, 822, 823. For this purpose, the transport roller 90, on which the drive wheels 821, 822, 823 are arranged in a rotationally fixed manner, is rotated in a rotational direction 92 about a rotational axis 9 along which the transport roller 90 extends. Therein, the pressure bars 84 are inserted into the cable receptacle 40 of the fastening structure 4 of the respective cable marker 2 to be printed, starting from their tapered area 87 and in the transport direction 12.

At the same time, the printing ribbon 72 is pressed on the labeling strip 3 with the print head 71. The contact surfaces 84 of the pressure bars 811, 821 serve as counter surfaces for the print head 71.

Thus, multiple cable markers 2 can be printed simultaneously in a cable marker strip 1 with cable markers 2 arranged side by side in rows I, II. The cable markers 2 can then be detached from the cable marker strip 1 along the notches 34 and/or perforations 35.

The method allows for printing the labeling surface 31 of the cable marker 2 in a manner that is easily legible and visible for a long time.

The invention claimed is:

1. A printer for printing on a cable marker strip including at least one row of cable markers, comprising (a) a transport roller;

(b) a plurality of drive wheels arranged in spaced relation on said transport roller for driving the cable marker strip in a transport direction upon rotation of said transport roller; and (c) a pressure bar arranged between a pair of drive wheels, said pressure bar having a smooth contact surface for engaging the cable markers of a row.

2. A printer as defined in claim 1, wherein said contact surface is arranged to engage a cable receptacle of each of the cable markers.

3. A printer as defined in claim 1, and further comprising a printer head for printing on a labeling surface of each cable marker, said contact surface of said pressure bar pressing the labeling surface of each of the cable markers in a pressure direction against said printer head via a spring force counter to a force of said printer head.

4. A printer as defined in claim 3, wherein said printer head is arranged above said pressure bar, and further comprising a printing ribbon arranged between said printer head and said pressure bar for printing on the cable markers.

5. A printer as defined in claim 3, wherein said pressure bar pivots about a pivot axis relative to said printer head and includes a carrier which extends transversely of said contact surface, and wherein said contact surface extends concentrically around said transport roller and includes a tapered portion which faces the at least one row of cable markers.

6. A printer as defined in claim 1, wherein said drive wheels have a contoured transport surface for engaging the cable markers.

7. A method for printing a cable marker of a strip of cable markers with a printer, comprising the steps of (a) inserting a pressure bar into a cable receptacle of a cable marker;

(b) pressing a printing ribbon with a printer head onto a cable marker labeling surface opposite the cable receptacle of the cable marker, said pressure bar countering a pressing force of the printer head; and (c) printing the cable marker labeling surface with the printing ribbon.

* * * * *